US011711659B2

(12) United States Patent
Song et al.

(10) Patent No.: US 11,711,659 B2
(45) Date of Patent: Jul. 25, 2023

(54) BONE CONDUCTION AUDIO APPARATUS

(71) Applicant: SHENZHEN YIYIN TECHNOLOGY CO., LTD, Guangdong (CN)

(72) Inventors: ZhongMing Song, Guangdong (CN); BinHua Cai, Guangdong (CN)

(73) Assignee: SHENZHEN YIYIN TECHNOLOGY CO., LTD, Guangdong (CN)

( * ) Notice: Subject to any disclaimer, the term of this patent is extended or adjusted under 35 U.S.C. 154(b) by 175 days.

(21) Appl. No.: 17/326,354

(22) Filed: May 21, 2021

(65) Prior Publication Data

US 2022/0322017 A1 Oct. 6, 2022

(30) Foreign Application Priority Data

Apr. 1, 2021 (CN) ..... 202120674099.9

(51) Int. Cl.
*H04R 1/00* (2006.01)
*H04R 25/00* (2006.01)

(52) U.S. Cl.
CPC ..... *H04R 25/606* (2013.01); *H04R 25/602* (2013.01); *H04R 25/607* (2019.05); *H04R 25/609* (2019.05); *H04R 2225/31* (2013.01)

(58) Field of Classification Search
CPC ..... H04R 1/00; H04R 2460/13
USPC ..... 381/150, 151
See application file for complete search history.

(56) References Cited

U.S. PATENT DOCUMENTS

2015/0310846 A1* 10/2015 Andersen ..... B05B 7/2464 381/71.6
2021/0092525 A1 3/2021 Zheng et al.
2021/0168481 A1* 6/2021 Wang ..... H04R 1/028

FOREIGN PATENT DOCUMENTS

KR 101297828 8/2013

* cited by examiner

*Primary Examiner* — George C Monikang
(74) *Attorney, Agent, or Firm* — JCIP Global Inc.

(57) ABSTRACT

A bone conduction audio apparatus includes at least one ear hook assembly. A main circuit board is provided in the ear hook assembly. Each ear hook assembly includes an operating unit, a line concentrator and a bone conduction transducer. Each operating unit is electrically connected with corresponding line concentrator by contact springs or connecting wires, and connected with the main circuit board via the line concentrator. Each bone conduction transducer is electrically connected with the main circuit board via corresponding line concentrator. A controller of the main circuit board receives touch signals from all operating units to determine and initiate relating earphone operating. The bone conduction audio apparatus adopts bilateral triggering interaction mechanism. The line concentrator is combined with the suspended bone conduction transducer.

19 Claims, 12 Drawing Sheets

BONE CONDUCTION AUDIO APPARATUS

CROSS-REFERENCE TO RELATED APPLICATION

This application claims the priority benefit of China application serial no. 202120674099.9, filed on Apr. 1, 2021. The entirety of the above-mentioned patent application is hereby incorporated by reference herein and made a part of this specification.

BACKGROUND

Technical Field

The present application relates to the field of electro-acoustic device, more particularly, to a bone conduction audio apparatus.

Description of Related Art

In a typical earphone market, speakers are designed to be an in-ear headset, or to be embraced in ear muffles on a bracket. It can impede hearing to wear conventional earphones for a long time. In addition, conventional earphones are not suitable in sports occasions, for being unable to release the ears.

There are two ways that sound travels: one is to travel by air vibration; the other is to travel by direct vibration. Bone conduction earphones transmit sounds by directly vibrating some human skeleton or skin tissues. Its working principle is converting electrical signals into mechanical vibration signals. The mechanical vibration transmits sounds by the human skeleton or skin tissues, clearly reducing sounds in a noisy environment, so that bone conduction earphones are popular and welcomed by the user.

In a typical bone conduction earphone, many devices, such as bone conduction transducer, operating unit etc. are assembled inside the ear hook assembly within limit space, which makes the whole product bulky and lack of convenience and comfort. Moreover, manipulation of the conventional bone conduction earphone is carried out by pushing plural buttons, such as plus button, minus button and switch button and so on. During exercises, it is inconvenient and to operate the plural buttons, with negative interacting experience.

There are structural and interacting design problems in conventional bone conduction earphones.

SUMMARY

In order to solve problems above, embodiments of the present disclosure provide a bone conduction audio apparatus based on a new designed bone conduction transducer and bilateral triggering interaction mechanism, with more compact structure, easier installation, and better interacting control.

In an embodiment of the present application relating electronic structure, it provides a bone conduction audio apparatus including at least one ear hook assembly, a main circuit board is provided in the ear hook assembly. Each ear hook assembly includes an operating unit, a line concentrator and a bone conduction transducer. Each operating unit is electrically connected with corresponding line concentrator by means of contact springs or connecting wires, and connected with the main circuit board via the line concentrator. Each bone conduction transducer is electrically connected with the main circuit board via corresponding line concentrator. A controller of the main circuit board receives touch signals from all operating units to determine and initiate relating earphone operating.

A first fastening structure or a second fastening structure is provided in hook housing of each ear hook assembly. The first fastening structure includes an elastic annular wall and a first clamping block disposed inside the elastic annular wall. The second fastening structure includes an interference wall and a second clamping block formed on the interference wall.

In detail, the line concentrator includes a pair of touch points and at least one pair of connecting points. The bone conduction transducer includes a vibration component and a magnet component cooperating with the vibration component. The vibration component includes a bracket. The bracket includes a hollow and cylindrical supporting member and an annular resilient plate mounted inside the supporting member. A peripheral of the magnet component is partially sheathed by the bracket. The resilient plate is connected with the magnet component. A panel is mounted above the supporting member. A mounting recess and a wiring groove are defined in the panel. The line concentrator is embedded in corresponding mounting recess of the bone conduction transducer.

In one embodiment of operating unit, each operating unit includes a touch button, a button panel and a button circuit. The touch button is a mechanical button, and the touch points on the line concentrator are set on or off by the contact springs of corresponding button circuit when the touch button is operated.

In another embodiment of operating unit, each operating unit includes a touch button, a button panel and a button circuit. The touch button is a capacitive touch button. The button circuit is connected with a pair of connecting points of corresponding line concentrator via connecting wires so as to deliver touch signals from the touch button, and the connecting wires are disposed in the wiring groove.

The bone conduction transducer is connected with a pair of connecting points of corresponding line concentrator via connecting wires, and the connecting wires are arranged in the wiring groove.

In order to achieve a fast and stable charge, a rechargeable battery and a microphone are connected with the main circuit board. A plurality of first charging terminals are connected with the main circuit board. Two inner magnetic buckles are respectively disposed on two sides of the first charging terminals. The bone conduction audio apparatus further includes a magnetic charger. The magnetic charger includes a plurality of second charging terminals and two outer magnetic buckles. In charging course, the inner magnetic buckle attracts the outer magnetic buckle, so that the first charging terminals are aligned and attached with the second charging terminals to start a stable charging of the rechargeable battery.

In an embodiment relating structural design, a bone conduction audio apparatus includes at least one ear hook assembly. A main circuit board is provided in the ear hook assembly. Each ear hook assembly includes an operating unit, a line concentrator and a bone conduction transducer. A mounting recess is defined in a surface of the bone conduction transducer, and the line concentrator is embedded in corresponding mounting recess of the bone conduction transducer. Each operating unit is electrically connected with corresponding line concentrator by means of contact springs or connecting wires and connected with the main circuit board via the line concentrator. Each bone conduction transducer is electrically connected with the main circuit board via corresponding line concentrator. A controller of the main circuit board receives touch signals from all operating units to determine and initiate relating earphone operating.

The bone conduction audio apparatus includes a left ear hook assembly, a right ear hook assembly and a holding body. A wiring conduit is arranged in the holding body. A first positioning part and a second positioning part are respectively formed on two distal ends of the wiring conduit. A first fixing member is set in the left ear hook assembly. A first location hole is defined in the first fixing member corresponding to the first positioning part. A second fixing member is set in the right ear hook assembly. A second location hole is defined in the second fixing member corresponding to the second positioning part.

A first fastening structure or a second fastening structure is provided in hook housings of the left ear hook assembly and the right ear hook assembly. The first fastening structure includes an elastic annular wall and a first clamping block disposed inside the elastic annular wall. The second fastening structure includes an interference wall and a second clamping block formed on the interference wall.

In detail, the line concentrator includes a pair of touch points and at least one pair of connecting points. The bone conduction transducer includes a vibration component and a magnet component cooperating with the vibration component. The vibration component includes a bracket. The bracket includes a hollow and cylindrical supporting member and an annular resilient plate mounted inside the supporting member. A peripheral of the magnet component is partially sheathed by the bracket. The resilient plate is connected with the magnet component. A panel is mounted above the supporting member. The mounting recess and a wiring groove are defined in the panel. An assembling structure is formed around the supporting member to fit with the first fastening structure or the second fastening structure.

In physical interacting design, each operating unit includes a touch button, a button panel and a button circuit. The touch button is a mechanical button. The touch points on the line concentrator are set on or off by the contact springs of corresponding button circuit when the touch button is operated.

In electronic interacting design, each operating unit includes a touch button, a button panel and a button circuit. The touch button is a capacitive touch button. The button circuit is connected with a pair of connecting points of corresponding line concentrator via connecting wires so as to deliver touch signals from the touch button, and the connecting wires are disposed in the wiring groove.

To achieve a fast and stable charge, a plurality of first charging terminals are connected with the main circuit board. Two inner magnetic buckles are respectively disposed on two sides of the first charging terminals. The bone conduction audio apparatus further includes a magnetic charger. The magnetic charger includes a plurality of second charging terminals and two outer magnetic buckles. In charging course, the inner magnetic buckle attracts the outer magnetic buckle, so that the first charging terminals are aligned and attached with the second charging terminals to start a stable charging of the rechargeable battery.

In detail, the magnet component includes a support substrate and a first magnet fixed with the support substrate. The bone conduction audio apparatus further includes a voice coil partially sheathing around the first magnet.

The support substrate includes a base. A flange is extended from an edge of the base and hanged on the resilient plate.

The magnet component further includes a second magnet mounted on the support substrate. And/or, the magnet component further includes a first magnetic piece disposed upon the first magnet.

The magnet component further includes a third magnet mounted upon the first magnetic piece.

The support substrate is a U-shaped iron or a T-shaped iron. And/or, the magnet component further includes a counterweight component combined with the support substrate outside.

Beneficial effect of the embodiment in the present application includes as follows.

The bone conduction audio apparatus uses new designed thin suspension type bone conduction transducer. A line concentrator is embedded in a top panel of the bone conduction transducer in a hidden way, and set up connection with corresponding operating unit, which makes each ear hook assembly ultra-compact. Moreover, the bone conduction audio apparatus in the disclosure adopts bilateral triggering interaction mechanism. A controller of the main circuit board receives all touch signals from the left ear hook assembly and the right ear hook assembly, and determines and initiates relating earphone operating according to a combination of touch signals, thereby providing a better interacting controlling experience. A line concentrator with touch points and connecting points are designed to regulate wiring inside and minimize volume of the ear hook assemblies. Contact springs or connecting wires are applied between the operating unit and corresponding line concentrator to set up electric connection. The line concentrator is a relay circuit between modules and the main circuit board, such as bone conduction transducer connected with the main circuit board via a pair of connecting points of the line concentrator, so that circuit layout inside the ear hook assembly is optimized to make the ear hook assembly manufactured more portable and compact.

In addition, the new designed bone conduction transducer of the bone conduction audio apparatus has special bracket, the resilient plate and the supporting member are manufactured by integral molding. The resilient plate is connected with the magnet component, thereby insuring consistency between the vibration component and the magnet component, meanwhile a thinner bone conduction transducer achieved.

BRIEF DESCRIPTION OF THE DRAWINGS

One or more embodiments will be described for exemplary purpose in accompany with corresponding drawings, which descriptions do not constitute limitation to embodiments of the present disclosure. Like reference numbers labeled in the drawings indicate similar components. Unless otherwise indicated, the drawings do not constitute limitation to the present disclosure.

DESCRIPTION OF THE EMBODIMENTS

Figure 1:
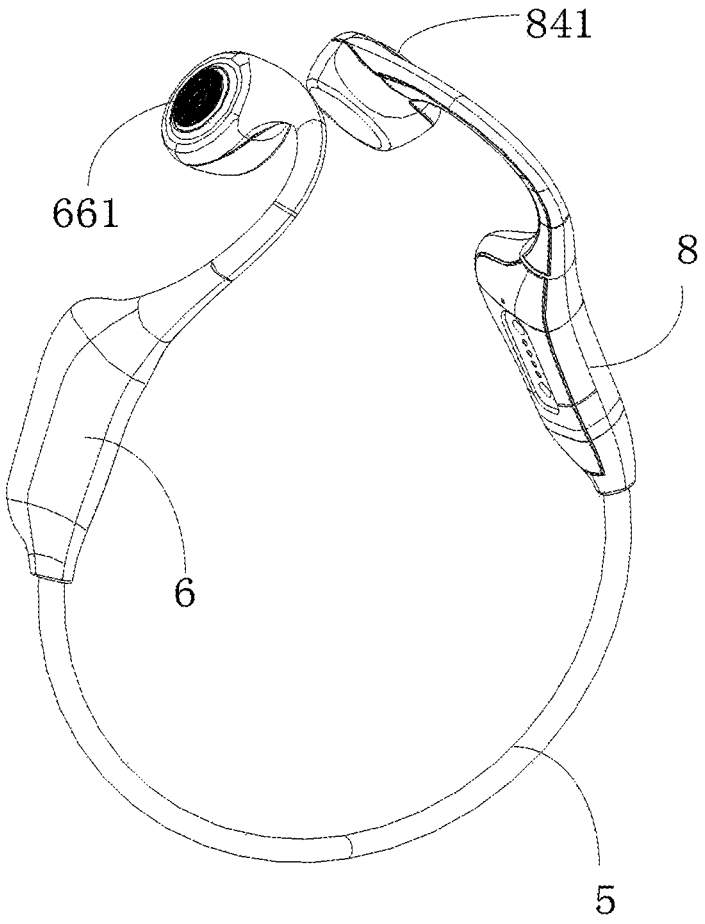
FIG. 1 is a schematic diagram view of a bone conduction audio apparatus provided in an embodiment of the present application.

In order to illustrate the purpose, technical solutions and the advantages of the present application more clearly, the present application will be described below in further details with reference to the drawings and embodiments. It is to be understood that specific embodiments described herein are merely for explaining, instead of limiting the present application.

Referring to FIG. 1 to FIG. 7, showing inner structure of a bone conduction audio apparatus. FIG. 8 to FIG. 15 shows different embodiments of a bone conduction transducer adopted by the bone conduction audio apparatus. The bone conduction transducer can be applied in a left ear hook assembly, for example left bone conduction transducer 67, and can be applied in a right ear hook assembly as well, for example right bone conduction transducer 85.

In general, the bone conduction audio apparatus includes a main circuit board and at least one ear hook assembly. Each ear hook assembly includes an operating unit, a line concentrator and a bone conduction transducer. A mounting recess is defined on a surface of the bone conduction transducer. The line concentrator is received in the mounting recess. The operating unit is connected with corresponding lien concentrator by means of contact springs or connecting wires, and linked to the main circuit board via the line concentrator. The bone conduction transducer is also linked to the main circuit board via corresponding line concentrator. A controller of the main circuit board receives touch signals from all operating units to determine and initiate relating earphone operating.

For example, one to one correspondence between the touch signals and earphone operations are listed as follows.

Power on: long-pressing a left touch button for 3 seconds to start up.

Power off: long-pressing the left touch button or a right touch button for 5 seconds to shutdown.

Pair mode: after long-pressing a left touch button for 3 seconds, enter pairing mode with 8 seconds.

Answer/hang up: a single click of the right touch button to fulfill answer and hang up a phone call.

Reject a phone call: long-pressing the right touch button about 2 seconds and release to reject a phone call.

Previous/next song: in music mode, triple click of the left touch button to play the previous song; in music mode, triple click of the right touch button to play the next song.

Volume up/down: double click of the left touch button to increase one bar volume; single click of the left touch button reducing one bar volume.

Earphone battery indicating: battery power can be directly displayed on screen in iOS system and some Android system appliances.

Earphone system reset: when charging the system will shut down and reset, without wiping pairing data.

Factory reset: in any state, press the left and right touch buttons together for 6 seconds, a red light will continuously flash. After a beep, the red light and a blue light flash alternatively to enter pairing mode, it refers that the factory reset is done.

Embodiments are illustrated as follows.

Detailed Embodiments

Referring to FIG. 1 to FIG. 7, inner structures of a bone conduction audio apparatus are shown.

In FIG. 1, the bone conduction audio apparatus includes a left ear hook assembly 6, a right ear hook assembly 8 and a holding body 5. When being worn, the left ear hook assembly 6 is rested on the left ear, the right ear hook assembly 8 is rested on the right ear, and the holding body 5 connecting the two assemblies around the back of the head. The left ear hook assembly 6 includes a left operating unit, a left bone conduction transducer 67 and a rechargeable battery 72. The right ear hook assembly 8 includes a right operating unit, a right bone conduction transducer 85, a main circuit board 7, a memory card 71, a microphone 74 and a magnetic charging module.

Figure 2:
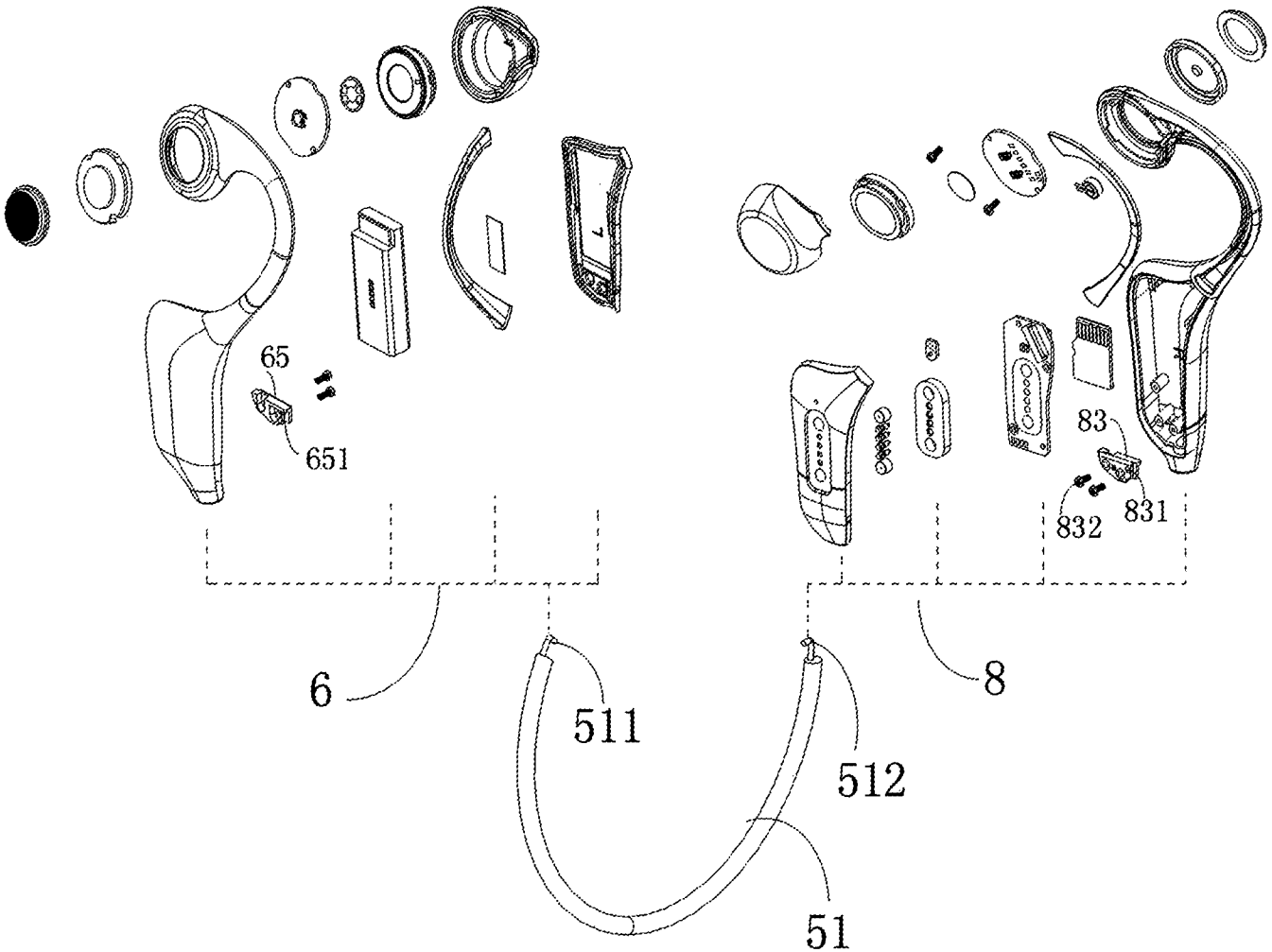
FIG. 2 is an exploded structural view of the bone conduction audio apparatus in the embodiment of the present application.

In FIG. 2, a wiring conduit is implanted in the holding body 5. A first positioning part 511 and a second positioning part 512 are formed at two distal ends of the wiring conduit. And connecting wiring between the left ear hook assembly 6 and the right ear hook assembly 8 are laid through the wiring conduit.

A first fixing member 65 is provided in the left ear hook assembly 6. A first location hole 651 is defined in the first fixing member 65 for receiving the first positioning part 511. A second fixing member 83 is mounted in the right ear hook assembly 8. A second location hole 831 is defined in the second fixing member 83 to receiving the second positioning part 512.

In assembly, the first positioning part 511 is inserted into the first location hole 651. After the first fixing member 65 is fastened by screws, the first positioning part 511 is kept fixed. The second positioning part 512 is inserted into the second location hole 831. After the second fixing member 83 is fastened by screws, the second positioning part 512 is kept fixed. The aforementioned fixing structure of the bone conduction audio apparatus simplifies assembly processes and improves assembling efficiency.

Figure 4:
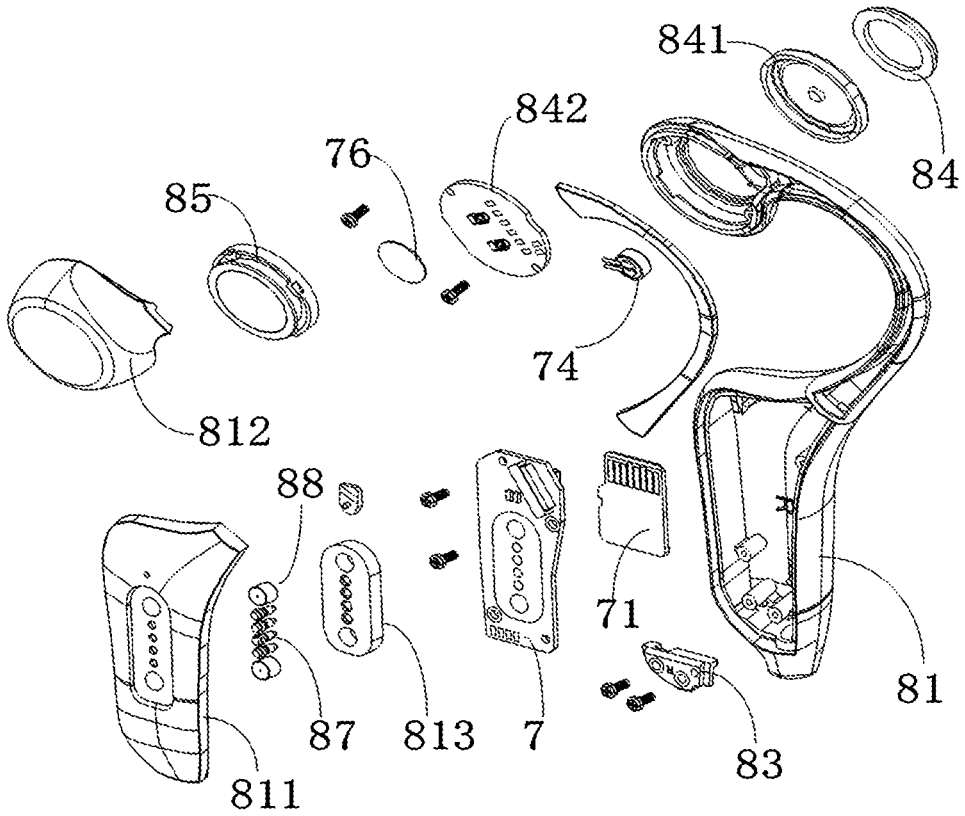
FIG. 4 is an exploded structural view of a right ear hook assembly provided by the embodiment of the present application.

Referring to FIG. 4, the right ear hook assembly 8 includes a hook housing 81, a body housing 811 and a speaker housing 812. A control chamber is formed combining the hook housing 81 and the body housing 811. A loudspeaker chamber is formed combining the hook housing 81 and the speaker housing 812.

The main circuit board 7, the memory card 71, the microphone 74 and the magnetic charging module are disposed in the control chamber of the right ear hook assembly 8. The right operating unit, the right bone conduction transducer 85 and the right line concentrator 76 are received in the loudspeaker chamber of the right ear hook assembly 8. The magnetic charging module is arranged on the main circuit board 7. The memory card 71 and the microphone 74 are connected with the main circuit board 7.

Figure 5:
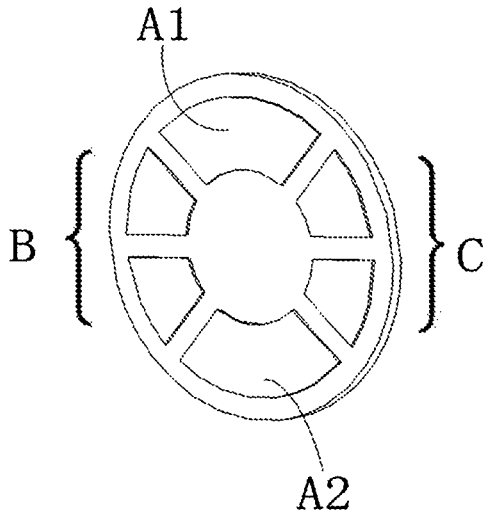
FIG. 5 is a structural view of a line concentrator in the embodiment of the present application.

In FIG. 5, the right line concentrator 76 includes a group of touch points to respectively connect the positive and negative poles, for example, touch point A1 and touch point A2. The right line concentrator 76 includes two groups of connecting points, for example, connecting points B and connecting points C.

In condition that the right operating unit is a capacitive touch button, the right bone conduction transducer 85 is set up connection via the connecting points B. The right operating unit is set up connection via the connecting points C. Structure and connectivity of the left line concentrator 75 in the left ear hook assembly 6 are identical.

The right operating unit includes a right touch button 84, a right button panel 841 and a right button circuit 842. The right touch button 84 can be a mechanical touch button or a capacitive touch button. The right line concentrator 76 is designed to adapt different electrical connection requirements of the operating unit, for example, contact springs in the mechanical touch button embodiment connect with the touch points on the line concentrator. Connecting wires in the capacitive touch button embodiment connect with corresponding connecting points on the line concentrator.

Figure 6:
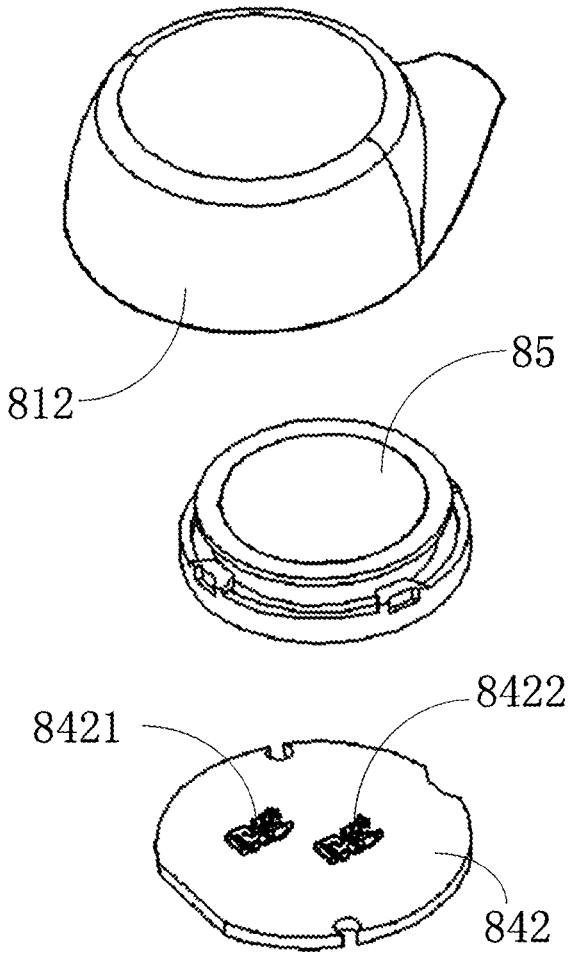
FIG. 6 is a partial structural view of the right ear hook assembly in the embodiment of the present application.

Referring to FIG. 4 and FIG. 6 together, in right operating unit, the right button circuit 842 sets electrical connection with the right line concentrator 76 by combination of a mechanical touch button and contact springs. In detail, there two contact springs, contact spring 8421 as a positive pole and contact spring 8422 as a negative pole. The contact spring 8421, 8422 respectively touch the touch points A1, A2 on the right line concentrator 76, and the touch points A1, A2 are switched on and off by the user's touch operation.

The right operating unit is connected with the main circuit board 7 via the right line concentrator 76. And the right bone conduction transducer 85 connects the main circuit board 7 via connecting points on the right line concentrator 76, thereby optimizing inner circuit layout of the right ear hook assembly.

Figure 3:
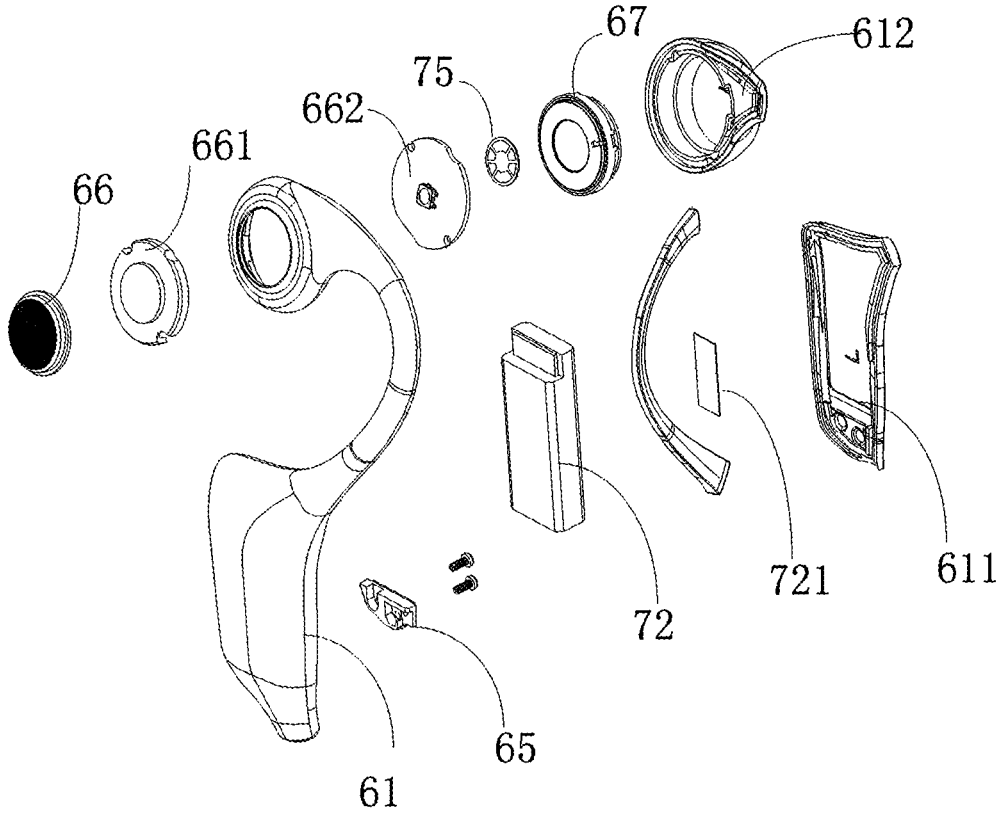
FIG. 3 is an exploded structural view of a left ear hook assembly provided by the embodiment of the present application.

In FIG. 3, the left ear hook assembly 6 includes a hook housing 61, a body housing 611 and a loudspeaker housing 612. A battery chamber is formed combing the hook housing 61 and the body housing 611. Another loudspeaker chamber is formed by combing the hook housing 61 and the loudspeaker housing 612.

A rechargeable battery 72 is accommodated in the battery chamber of the left ear hook assembly 6. The left operating unit, the left bone conduction transducer 67 and the left line concentrator 75 are received in the loudspeaker chamber of the left ear hook assembly 6. The rechargeable battery 72 is connected with the main circuit board 7 by a battery circuit 721. The left operating unit includes a left touch button 66, a left button panel 661 and a left button circuit 662.

In the same way, the left touch button 66 can be a mechanical touch button or a capacitive touch button. The left line concentrator 75 is designed to adapt different electrical connection requirements of the operating unit, for example, contact springs of the mechanical touch button connect with the touch points A1, A2 on the line concentrator 75. In the capacitive touch button embodiment, connecting wires connect with corresponding connecting points B or C on the let line concentrator 75.

Please refer to FIG. 3 and FIG. 6, in the shown embodiment, a combination of a mechanical touch button and contact springs are employed in the left operating unit to set up electric connection between the left button circuit 662 and the left line concentrator 75.

The left operating unit is connected with the main circuit board 7 via the left line concentrator 75. And the left bone conduction transducer 67 connects the main circuit board 7 via connecting points on the left line concentrator 75, thereby optimizing inner circuit layout of the left ear hook assembly.

A controller of the main circuit board 7 receives all touch signals from the operating units, and then determines and initiates earphone operating. The bone conduction audio apparatus employs a bilateral triggering interaction mechanism involving the left ear hook assembly 6 and the right ear hook assembly 8, so as to provide a better interacting and operating experience.

Figure 7:
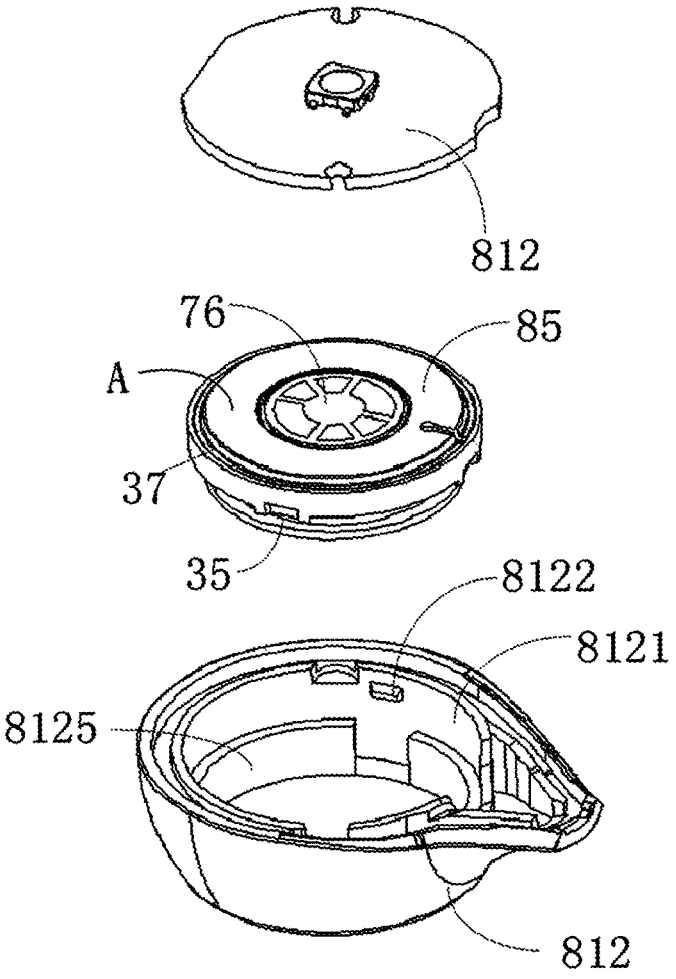
FIG. 7 is a partial structural view in reversed perspective of the right ear hook assembly in the embodiment of the present application.

In FIG. 7, fastening structures are formed in loudspeaker chambers in the left ear hook assembly 6 and the right ear hook assembly 8. Take the right ear hook assembly 8 for example to introduce the fastening structure. The fastening structure of the left ear hook assembly 6 is identical.

As shown in FIG. 6 and FIG. 7, a first fastening structure or a second fastening structure is provided in loudspeaker housing 812 of the right ear hook assembly 8. The first fastening structure is formed in an upper portion of the loudspeaker housing 812. The second fastening structure is formed on a lower portion of the loudspeaker housing 812. An assembling structure is formed around the supporting member to fit with the first fastening structure or the second fastening structure.

When the right bone conduction transducer 85 is plugged with a surface A upward, the first fastening structure is applied. The first fastening structure includes an elastic annular wall 8121 and a first clamping block 8122 formed inside the annular wall 8121. In present embodiment, the assembling structure is an engaging rim 37. In assembly, a panel 32 of the right bone conduction transducer is squeezed against the annular wall 8121, and the engaging rim 37 of the panel 32 buckles with the first clamping block 8122 so as to achieve a fast assembly.

Figure 19:
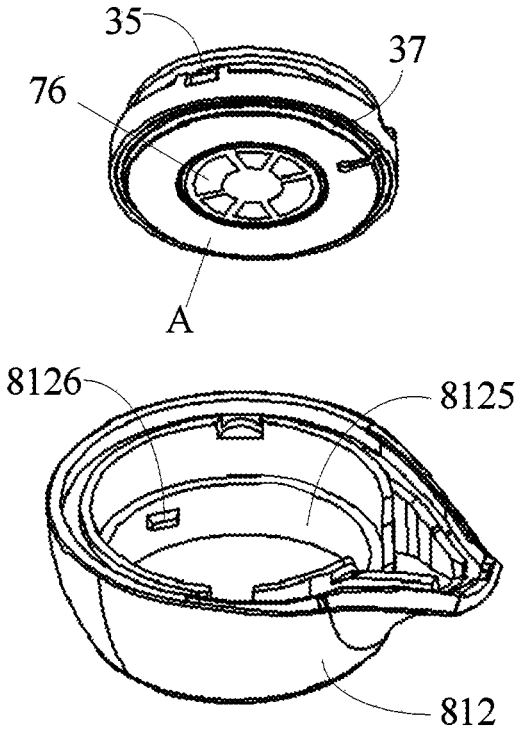
FIG. 19 is a structural view of a second fixing member of the bone conduction audio apparatus in the embodiment of the present application.

Referring to FIG. 19, when the right bone conduction transducer 85 is plugged with the surface A downward, the second fastening structure is applied. The second fastening structure includes a resilient interference wall 8125 and a second clamping block 8126 formed inside the interference wall 8125. In present embodiment, the assembling structure is a slot 35. In assembly process, the panel 32 of the right bone conduction transducer is squeezed against the interference wall 8125, and the slot 35 is engaged with the second clamping block 8126 so as to achieve a fast assembly.

The first or the second fastening structure make the bone conduction transducer only need one plug operation finishing installation to the ear hook assembly, without screws or cohesive glue, in a simple and fast assembling way.

In present embodiment, each bone conduction transducer includes a vibration component and a magnet component 20 engaged with the vibration component. The vibration component includes a bracket 10. The bracket 10 includes a hollow and cylindrical supporting member 11, and a resilient plate 12 is disposed inside the supporting member 11. Peripheral of the magnet component 20 is partially sheathed by the bracket 10. The resilient plate 12 is connected with the magnet component 20, and a panel 30 is mounted above the supporting member 11. The mounting recess 32 and wiring groove 31 are defined in a surface of the panel 30.

In an interacting design of the mechanical touch button, each operating unit includes a touch button, a button panel and a button circuit. The touch button is a mechanical button, and the touch points on the line concentrator are set on or off by the contact springs of corresponding button circuit when the touch button is operated.

In an interacting design of the capacitive touch button, each operating unit includes a touch button, a button panel and a button circuit. The touch button is a capacitive touch button. The button circuit is connected with a pair of connecting points of corresponding line concentrator via connecting wires so as to deliver touch signals from the touch button, and the connecting wires are disposed in the wiring groove.

In order to achieve a fast and stable charge, a magnetic charging module is provided on the main circuit board 7. A plurality of first charging terminals 87 are connected with the main circuit board 7. Two inner magnetic buckles 88 are respectively disposed on two sides of the first charging terminals 87 for magnetic location. The first charging terminals 87 and inner magnetic buckle 88 are supported in a socket base 813.

Figure 17:
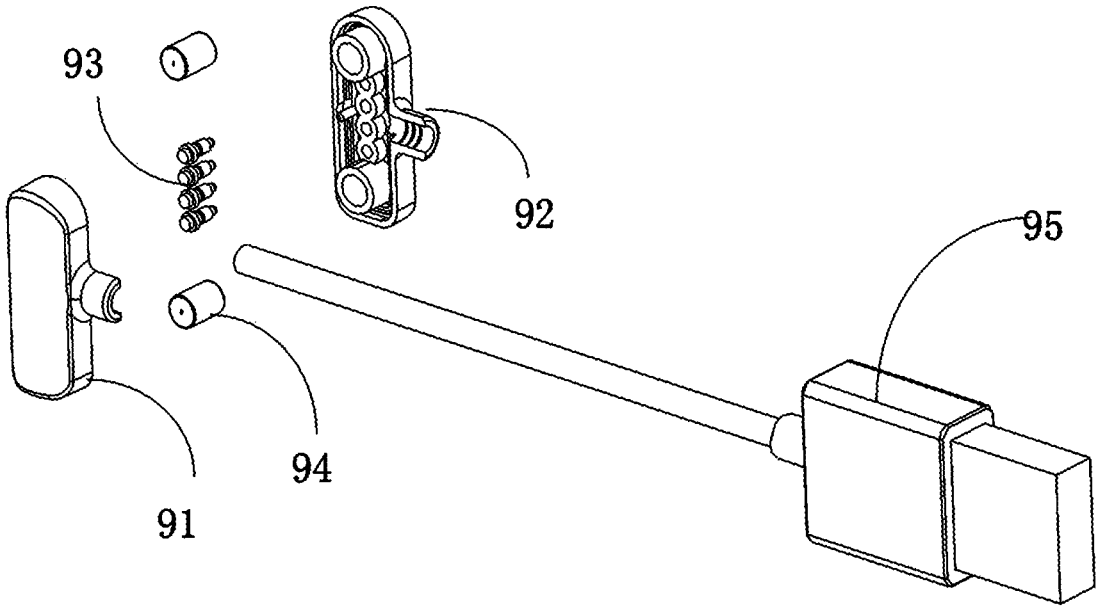
FIG. 17 is a structural view of a charger attachable with the bone conduction audio apparatus in the embodiment of the present application.

Referring to FIG. 17, the bone conduction audio apparatus further includes a magnetic charger capable of being connected with the first charging terminals 87. The magnetic charger includes a first case 91 and a second case 92. A receiving chamber is defined by the first case 91 and the second case 92. A plurality of second charging terminals 93 and outer magnetic buckle 94 are disposed in the receiving chamber. The plurality of second charging terminals 93 is connected with a USB plug. In charging process, the inner magnetic buckle 88 attracts the outer magnetic buckle 94, aligning the first charging terminals 87 and the second charging terminals 93 and sticking with each other to start charging the rechargeable battery.

In FIG. 8 to FIG. 15, showing concrete and different evolving embodiments. Take the right bone conduction transducer 85 as an example to introduce structure of each loudspeaker. The structure of the left bone conduction transducer 67 is identical with right one, the same description is omitted.

Figure 8:
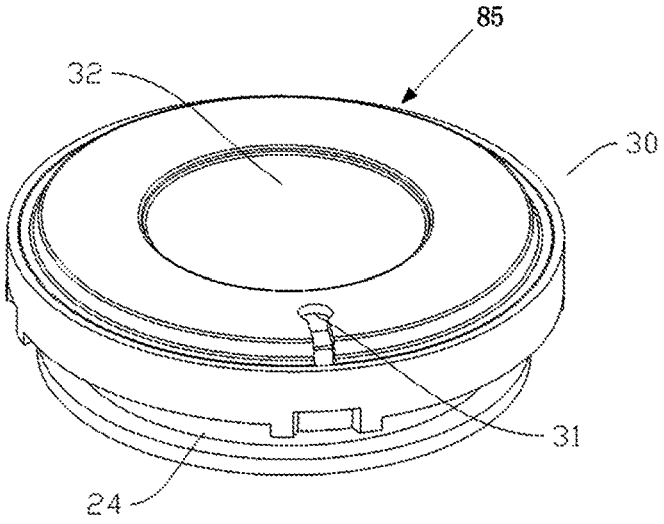
FIG. 8 is a structural view of a bone conduction transducer of the bone conduction audio apparatus in the embodiment of the present application.
Figure 9:
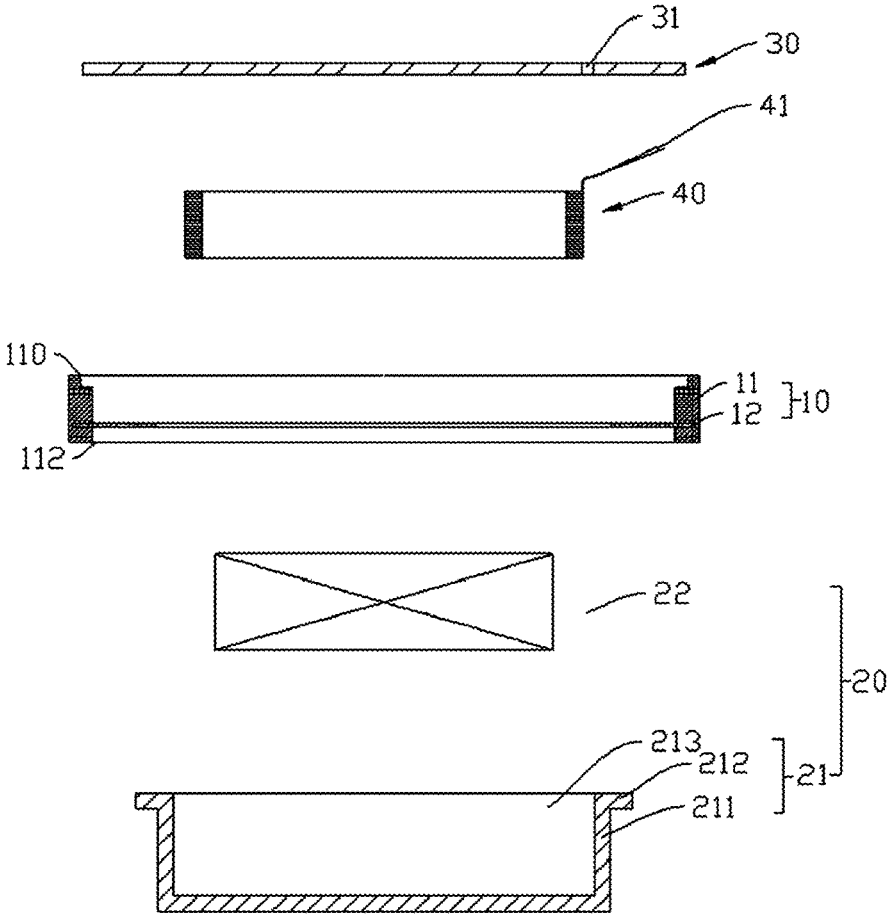
FIG. 9 is a breakdown structural view of the bone conduction transducer in the embodiment of the present application.

FIG. 8 and FIG. 9 show the preferred embodiment of the bone conduction transducer of the bone conduction audio apparatus. The bone conduction transducer can be installed in the bone conduction audio apparatus with advantages of fewer accessories, convenient and fast assemble, less leakage of sound, high vibration frequency, low power consumption, and low distortion. Fabrications of the bone conduction transducer have merits of simple process, less procedure, mass production in automatic line, high assemble efficiency and low reject ratio.

Figure 10:
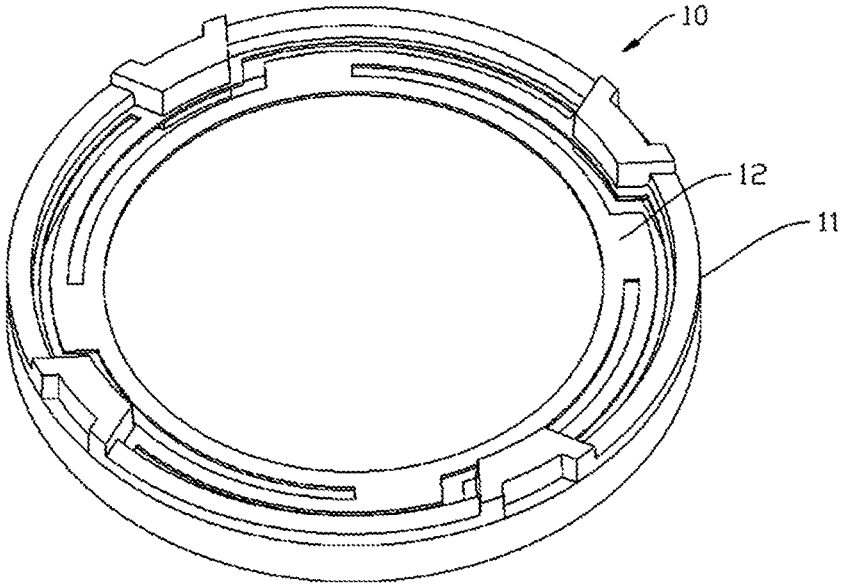
FIG. 10 is a structural view of a bracket of the bone conduction transducer in the embodiment of the present application.
Figure 11:
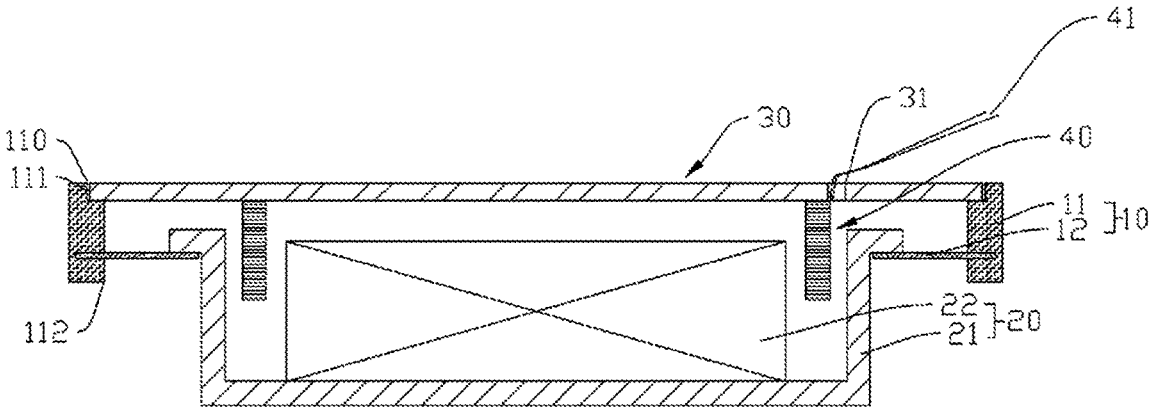
FIG. 11 is a section view of the bone conduction transducer in the embodiment of the present application.

In FIG. 9 and FIG. 10, the bone conduction transducer includes a vibration component, a magnet component 20, a panel 30 and a voice coil 40. The vibration component influenced by magnetic field changing with the magnet component 20, vibrating and generating sounds.

In the embodiment, the vibration component includes a bracket 10. The bracket 10 is assembled with the magnet component 20. The bracket 10 includes a supporting member 11 and a resilient plate 12. The supporting member 11 is a hollow and cylindrical tube, and includes a first opening 110 and a second opening 112. The first opening 110 and the second opening 112 are communicated. Or the supporting member 11 can be a substantially cylindrical tube. It is understood that the supporting member 11 is not limited to a cylindrical tube. In one embodiment, a limit notch is defined in the supporting member at the first opening 110 to stop the panel 30. In some embodiment, the supporting member 11 can be a plastic member. In the other embodiment, the supporting member 11 is not confined to plastic materials. In some embodiment, the resilient plate 12 can in annular shape. The resilient plate 12 can be mounted on an inside wall of the supporting member 11, and bulging inwards. The resilient plate 12 can be a circular ring, and the resilient plate 12 is disposed near the second opening 112 of the supporting member 11. Annular surface of the resilient plate 12 is partially inserted in the supporting member 11. The resilient plate 12 is coaxial with the supporting member 11. i.e., a central hole of the resilient plate 12 is concentric with a central hole of the supporting member 11. In some embodiment, the resilient plate 12 is integrally formed with the supporting member 11. In some embodiment, the resilient plate 12 is formed with the supporting member 11 by integral molding.

In present embodiment, the bone conduction transducer further includes a voice coil 40. The voice coil 40 can be in cylinder shape. Radical dimension of the voice coil 40 can be smaller than radical dimension of the supporting member 11. The voice coil 40 is partially inserted into the resilient plate 12, with one end portion connected with the panel 30. In detail, the voice coil 40 can be pasted with the panel. In the embodiment, leads 41 are extended from the voice coil 40, and the leads 41 can penetrate through the panel 30.

The magnet component 20 includes a support substrate 21. In present embodiment, the support substrate 21 can be a U-shaped iron. It is understood that the support substrate 21 is not limited to a U-shaped iron. In present embodiment, the support substrate 21 includes a base 211 and a flange 212. The base 211 is a tubular structure with an opening in one end portion thereof. In detail, the base 211 can be cylindrical and the radical dimension is less than the radical dimension of the resilient plate 12. An accommodating chamber 213 is formed inside the base 211. In some embodiment, the bracket 10 partially sheathes the support substrate 21 outside. The flange 212 is positioned at the end having the opening of the base 211 and extending along a radical direction. The flange 212 is formed along a circumferential direction, and hanging on the resilient plate 12, so as to detachably mounted the vibration component with the magnet component 20. In assembly, the base 211 can be put through the central hole of the resilient plate 12, leaving the flange 212 hanging on the resilient plate 12, thus a thinner bone conduction transducer can be made.

In present embodiment, the magnet component 20 further includes a first magnet 22. The first magnet 22 is mounted in the accommodating chamber 213 of the support substrate 21. In some embodiment, the first magnet 22 can be cylindrical, and the radical dimension is less than that of the accommodating chamber 213. The first magnet 22 is partially surrounded by the voice coil 40 coaxial with the first magnet 22.

The panel 30 is placed at the first opening 110 of the supporting member 11, and in detail placed in the limit notch of the supporting member 11. The panel 30 is discoid, and radical dimension of the panel 30 is less than that of first opening 110. A wiring groove 31 is defined through the panel 30. The wiring groove 31 is used to lay the leads connected with the voice coil 40. In some embodiment, the panel 30 is made of plastic material or metal materials.

Figure 12:
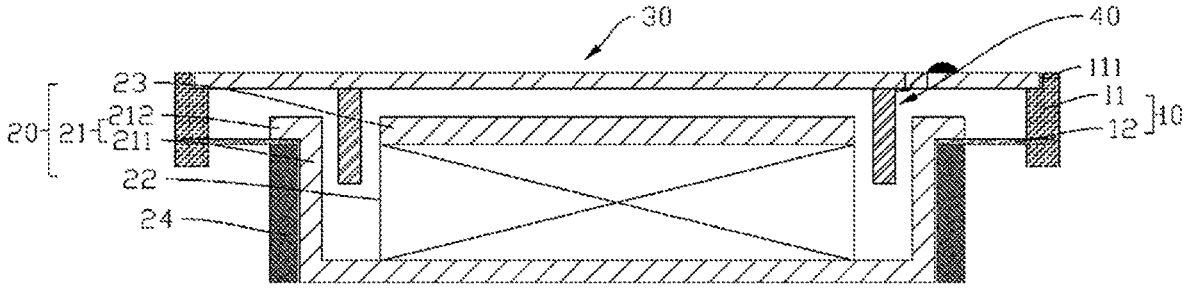
FIG. 12 is a section view of a bone conduction transducer in a second embodiment of the present application.

FIG. 12 showing a second embodiment of the bone conduction transducer, differences between the first embodiment and the second embodiment are listed below: the magnet component 20 further includes a first magnetic piece 23. The first magnetic piece 23 can be disposed on the first magnet 22. In some embodiment, the first magnetic piece 23 can be a washer, and the radical dimension of the first magnetic piece 23 should be fitted with the radical dimension of the first magnet 22.

In addition, in present embodiment, the magnet component 20 further includes a counterweight component 24. The counterweight component 24 can be cylindrical, surrounding the support substrate 21 outside. In some embodiment, the counterweight component 24 is arranged outside the base 211, a U-shaped iron. The counterweight component 24 can be a metal part or a ceramic part, for example can be an iron ring. It is understood that in some other embodiment, the counterweight component 24 is not limit to a metal part or a ceramic part.

Figure 13:
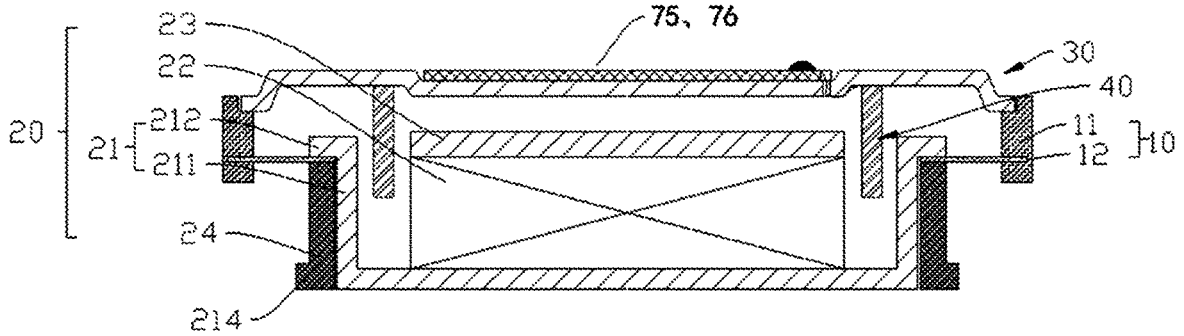
FIG. 13 is a section view of a bone conduction transducer in a third embodiment of the present application.

Referring to FIG. 13, showing a third embodiment of the bone conduction transducer, differences between the third embodiment and the second embodiment is that: the counterweight component 24 is not limit to a cylindrical shape, and a counterweight flange 241 is formed on one end portion of the counterweight component 24.

The panel 30 is not confined to a discoid shape, and in present embodiment, the left line concentrator 75 and the right line concentrator 76 are respectively placed in corresponding panel. The left and right line concentrator 75, 76 function as a PCB board or a FPC board. Top surface of the panel 30 forms a concave mounting recess 32 to receive corresponding left line concentrator 75, or right line concentrator 76.

Figure 14:
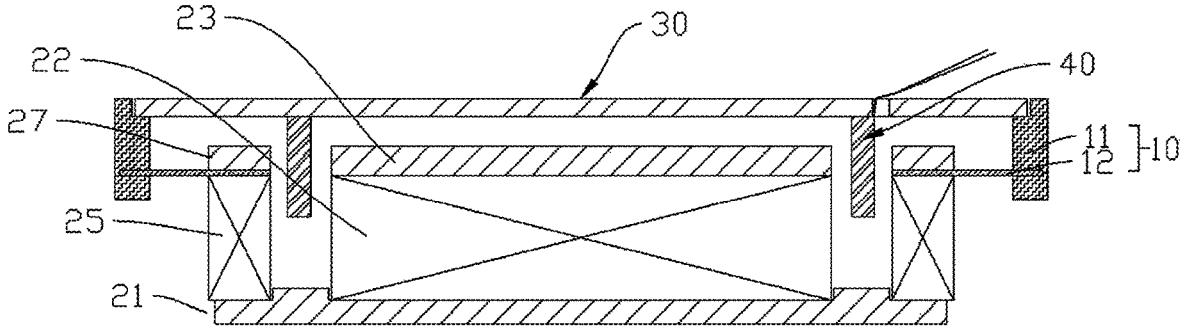
FIG. 14 is a section view of a bone conduction transducer in a fourth embodiment of the present application.

Referring to FIG. 14, it shows a forth embodiment of the bone conduction transducer. Differences between the forth embodiment and the second embodiment are listed below: the support substrate 21 can be a T-shaped iron. The magnet component 20 further includes a second magnet 25, and the second magnet 25 is placed upon the support substrate 21. In detail, the second magnet 25 can be mounted on the T-shaped iron. The second magnet 25 is cylindrical. In present embodiment, the magnet component 20 further includes a second magnetic piece 27. The second magnetic piece 27 can be disposed on the second magnet 25. The annular surface of the resilient plate 12 can partially inserted between the second magnetic piece 27 and the second magnet 25.

Figure 15:
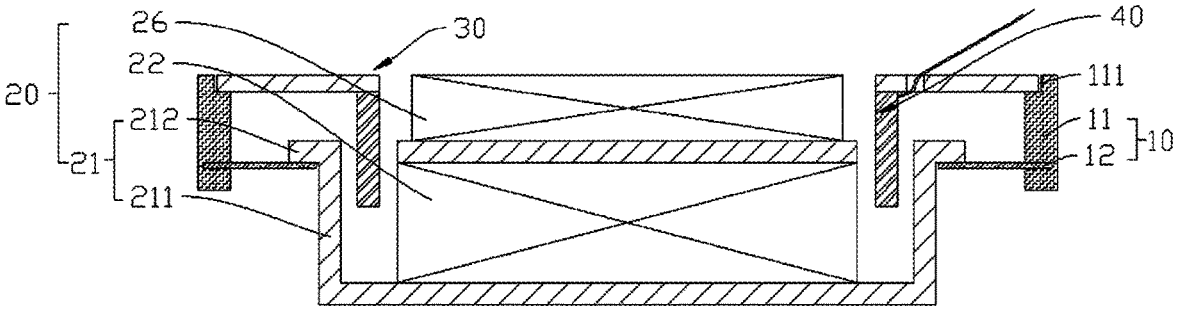
FIG. 15 is a section view of a bone conduction transducer in a fifth embodiment of the present application.

In FIG. 15, it shows the fifth embodiment of the bone conduction transducer. Difference between the fifth embodiment and the second embodiment is that: the counterweight component 24 can be omitted. The panel 30 can be discoid, and the panel 30 is coaxial with the first magnet 22.

In present embodiment, the magnet component 20 further includes a third magnet 26. The third magnet 26 can be in cylindrical shape, and placed on the first magnetic piece 23. Radical dimension of the third magnet 26 is less than that of the first magnet 22, and height thereof is less than height of the first magnet 22.

Figure 16:
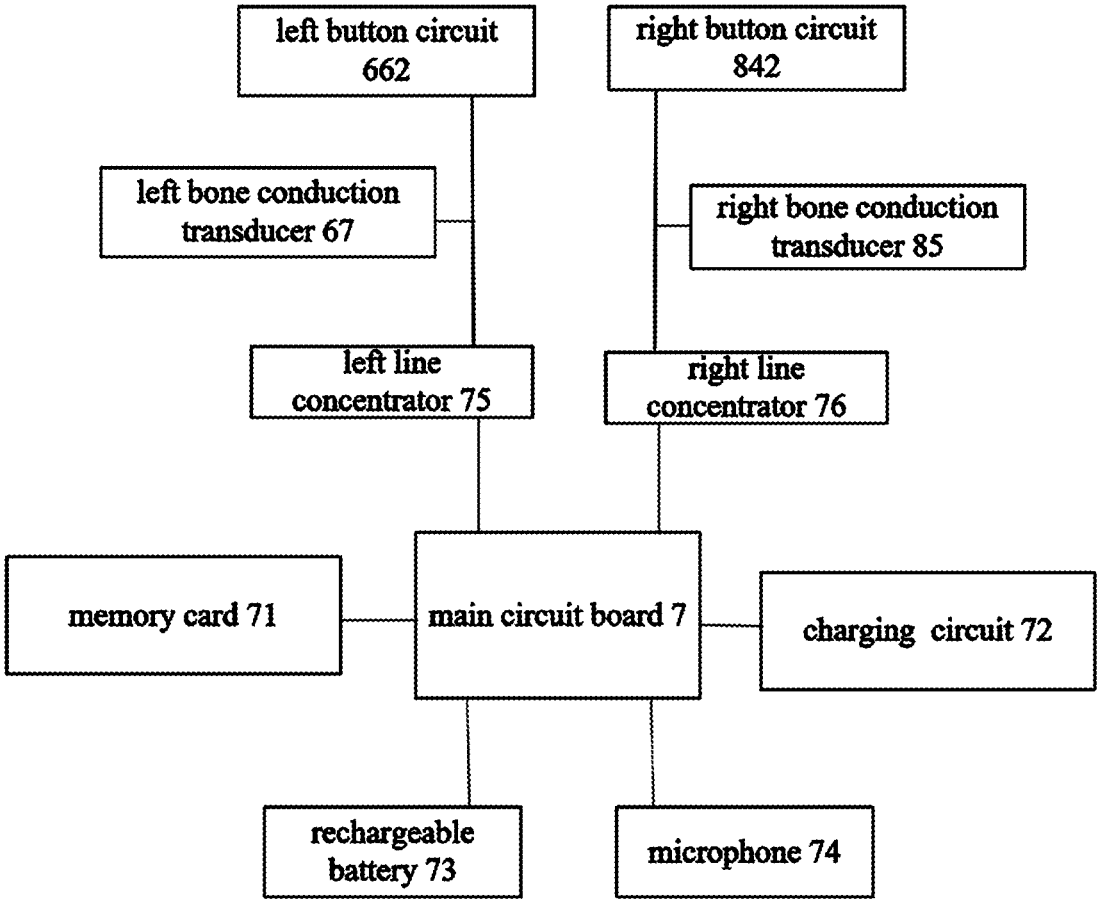
FIG. 16 is a schematic diagram view of circuit connection of the bone conduction audio apparatus in the embodiment of the present application.

Referring to FIG. 16, it relates to circuit layouts and connections in the bone conduction audio apparatus, showing connections between the electronic components in the left ear hook assembly 6 and the right ear hook assembly 8.

Figure 18:
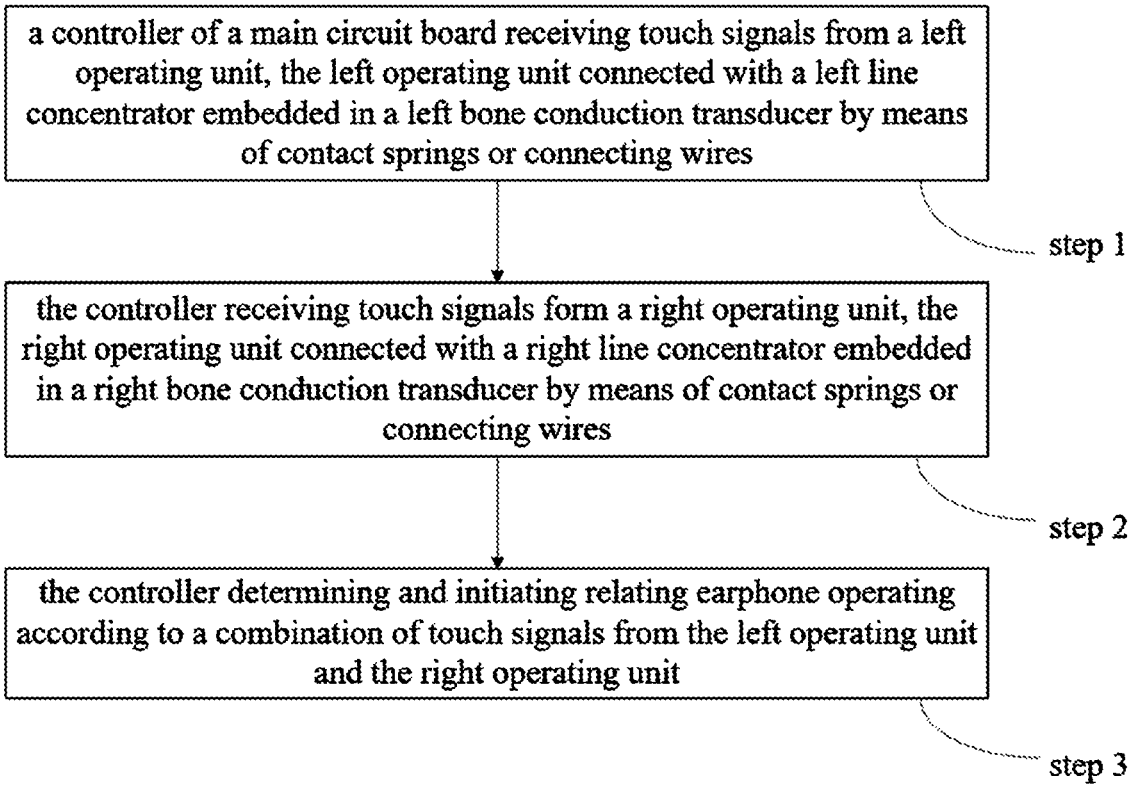
FIG. 18 is a flow chart of a controlling method of the bone conduction audio apparatus in the embodiment of the present application.

Referring to FIG. 18, a bone conduction audio apparatus controlling method includes the following steps.

Step 1: a controller of a main circuit board receives touch signals from a left operating unit, and the left operating unit is connected with a left line concentrator embedded in a left bone conduction transducer by means of contact springs or connecting wires. The left operating unit and the left bone conduction transducer are connected with the main circuit board via the left line concentrator.

Step 2: the controller receives touch signals form a right operating unit, the right operating unit is connected with a right line concentrator embedded in a right bone conduction transducer by means of contact springs or connecting wires. The right operating unit and the right bone conduction transducer are connected with the main circuit board via the right line concentrator.

Step 3: the controller determines and initiates relating earphone operating according to a combination of touch signals from the left operating unit and the right operating unit.

The bone conduction audio apparatus uses new designed thin suspension type bone conduction transducer to minimize the entire device volume. The bone conduction audio apparatus adopts bilateral triggering interaction mechanism. A controller of the main circuit board receives all touch signals from the left ear hook assembly 6 and the right ear hook assembly 8, and determines and initiates relating earphone operating according to a combination of touch signals, so as to provide a better interacting means. A line concentrator with touch points and connecting points is provided. Contact springs or connecting wires are applied between the operating unit and corresponding line concentrator to set up electric connection. The line concentrator is a relay circuit between modules and the main circuit board 7, so that circuit layout inside the ear hook assembly is optimized to make the ear hook assembly manufactured more portable and compact.

In the left ear hook assembly 6 and in the right ear hook assembly 8, a corresponding fastening structure is provided. The first or the second fastening structure provides a plug-in mounting structure assembled with corresponding loudspeaker housing without screws or cohesive glue, the plug-in mounting structure simplifies assembly processes and improves assembling efficiency.

The bone conduction transducer of the bone conduction audio apparatus has special bracket, the resilient plate and the supporting member of the bracket are manufactured by integral molding. And the resilient plate is connected with the magnet component, thereby insuring consistency between the vibration component and the magnet component, meanwhile a thinner bone conduction transducer achieved.

The bone conduction audio apparatus having magnetic charging device. In addition, a first positioning part and a second positioning part are provided on holding body. A first or a second fixing member is set in one of ear hook assemblies, the fixing structure of the bone conduction audio apparatus simplifies assembly processes and improves assembling efficiency.

Disclosures above only describe embodiments of the present application, and should not be deemed as limiting the protection scope of the present application. Equivalent structures or procedures made based on the specification and drawings, or applied to alternative associated technical areas directly or indirectly should also fall within the protection scope of the present application.

What is claimed is:

1. A bone conduction audio apparatus, comprising:

at least one ear hook assembly, a main circuit board provided in the ear hook assembly, each ear hook assembly comprising an operating unit, a line concentrator and a bone conduction transducer;

wherein a mounting recess is defined in a surface of the bone conduction transducer, the line concentrator is embedded in corresponding mounting recess of the bone conduction transducer, the line concentrator comprises a pair of touch points and at least one pair of connecting points, each operating unit is electrically connected with the touch points of the line concentrator by contact springs or connecting wires, and connected with the main circuit board via the connecting points of the line concentrator; each bone conduction transducer is electrically connected with the main circuit board via corresponding line concentrator; a controller of the main circuit board receives touch signals from all operating units to determine and initiate relating earphone operating.

2. The bone conduction audio apparatus of claim 1, wherein a first fastening structure or a second fastening structure is provided in a hook housing of each ear hook assembly, the first fastening structure comprises an elastic annular wall and a first clamping block disposed inside the elastic annular wall, and the second fastening structure comprises an interference wall and a second clamping block formed on the interference wall.

3. The bone conduction audio apparatus of claim 1, wherein the bone conduction transducer comprises a vibration component and a magnet component cooperating with the vibration component; the vibration component comprises a bracket, the bracket comprises a hollow and cylindrical supporting member and an annular resilient plate mounted inside the supporting member; a peripheral of the magnet component is partially sheathed by the bracket, the resilient plate is connected with the magnet component, a panel is mounted above the supporting member, a mounting recess and a wiring groove are defined in the panel, and the line concentrator is embedded in corresponding mounting recess of the bone conduction transducer.

4. The bone conduction audio apparatus of claim 3, wherein each operating unit comprises a touch button, a button panel and a button circuit, the touch button is a mechanical button, and the touch points on the line concentrator are set on or off by the contact springs of corresponding button circuit when the touch button is operated.

5. The bone conduction audio apparatus of claim 3, wherein each operating unit comprises a touch button, a button panel and a button circuit, the touch button is a capacitive touch button, the button circuit is connected with a pair of connecting points of corresponding line concentrator via connecting wires so as to deliver touch signals from the touch button, and the connecting wires are disposed in the wiring groove.

6. The bone conduction audio apparatus of claim 3, wherein the bone conduction transducer is connected with a pair of connecting points on corresponding line concentrator via connecting wires, and the connecting wires are arranged in the wiring groove.

7. The bone conduction audio apparatus of claim 1, wherein a rechargeable battery and a microphone are connected with the main circuit board, and a plurality of first charging terminals are connected with the main circuit board, two inner magnetic buckles are respectively disposed on two sides of the first charging terminals, the bone conduction audio apparatus further comprises a magnetic charger, the magnetic charger comprises a plurality of second charging terminals and two outer magnetic buckles, in charging course, the inner magnetic buckle attracts the outer magnetic buckle, so that the first charging terminals are aligned and attached with the second charging terminals to start a stable charging of the rechargeable battery.

8. Bone conduction audio apparatus, comprising:

at least one ear hook assembly, a main circuit board provided in the ear hook assembly, each ear hook assembly comprising an operating unit, a line concentrator and a bone conduction transducer;

wherein a mounting recess is defined in a surface of the bone conduction transducer, the line concentrator is embedded in corresponding mounting recess of the bone conduction transducer, the line concentrator comprises a pair of touch points and at least one pair of connecting points, each operating unit is electrically connected with the touch points of the line concentrator by contact springs or connecting wires and connected with the main circuit board via the connecting points of the line concentrator; each bone conduction transducer is electrically connected with the main circuit board via corresponding line concentrator; a controller of the main circuit board receives touch signals from all operating units to determine and initiate relating earphone operating.

9. The bone conduction audio apparatus of claim 8, wherein the bone conduction audio apparatus comprises a left ear hook assembly, a right ear hook assembly and a holding body, a wiring conduit is arranged in the holding body; a first positioning part and a second positioning part are respectively formed on two distal ends of the wiring conduit, a first fixing member is set in the left ear hook assembly, a first location hole is defined in the first fixing member corresponding to the first positioning part, a second fixing member is set in the right ear hook assembly, and a second location hole is defined in the second fixing member corresponding to the second positioning part.

10. The bone conduction audio apparatus of claim 9, wherein a first fastening structure or a second fastening structure is provided in hook housings of the left ear hook assembly and the right ear hook assembly, the first fastening structure comprises an elastic annular wall and a first clamping block disposed inside the elastic annular wall, and the second fastening structure comprises an interference wall and a second clamping block formed on the interference wall.

11. The bone conduction audio apparatus of claim 10, wherein the bone conduction transducer comprises a vibration component and a magnet component cooperating with the vibration component; the vibration component comprises a bracket, the bracket comprises a hollow and cylindrical supporting member and an annular resilient plate mounted inside the supporting member; a peripheral of the magnet component is partially sheathed by the bracket, the resilient plate is connected with the magnet component, a panel is mounted above the supporting member, the mounting recess and a wiring groove are defined in the panel, an assembling structure is formed around the supporting member to fit with the first fastening structure or the second fastening structure.

12. The bone conduction audio apparatus of claim 11, wherein each operating unit comprises a touch button, a button panel and a button circuit, the touch button is a mechanical button, the touch points on the line concentrator are set on or off by the contact springs of corresponding button circuit when the touch button is operated.

13. The bone conduction audio apparatus of claim 11, wherein each operating unit comprises a touch button, a button panel and a button circuit, the touch button is a capacitive touch button, the button circuit is connected with a pair of connecting points of corresponding line concentrator via connecting wires so as to deliver touch signals from the touch button, and the connecting wires are disposed in the wiring groove.

14. The bone conduction audio apparatus of claim 8, wherein a plurality of first charging terminals are connected with the main circuit board, two inner magnetic buckles are respectively disposed on two sides of the first charging terminals, the bone conduction audio apparatus further comprises a magnetic charger, the magnetic charger comprises a plurality of second charging terminals and two outer magnetic buckles, in charging course, the inner magnetic buckle attracts the outer magnetic buckle, so that the first charging terminals are aligned and attached with the second charging terminals to start a stable charging of the rechargeable battery.

15. The bone conduction audio apparatus of claim 11, wherein the magnet component comprises a support substrate and a first magnet fixed with the support substrate, and the bone conduction audio apparatus further comprises a voice coil partially sheathing around the first magnet.

16. The bone conduction audio apparatus of claim 15, wherein the support substrate comprises a base, and a flange is extended from an edge of the base and hanged on the resilient plate.

17. The bone conduction audio apparatus of claim 15, wherein the magnet component further comprises a second magnet mounted on the support substrate;

and/or, the magnet component further comprises a first magnetic piece disposed upon the first magnet.

18. The bone conduction audio apparatus of claim 17, wherein the magnet component further comprises a third magnet mounted upon the first magnetic piece.

19. He bone conduction audio apparatus of claim 15, wherein the support substrate is a U-shaped iron or a T-shaped iron;

and/or, the magnet component further comprises a counterweight component combined with the support substrate outside.

* * * * *